United States Patent [19]

Lattur

[11] 3,956,866

[45] May 18, 1976

[54] PACKAGING METHOD AND APPARATUS

[75] Inventor: Vincent Lattur, Cuyahoga Falls, Ohio

[73] Assignee: Automated Packaging Systems, Inc., Cleveland, Ohio

[22] Filed: June 28, 1974

[21] Appl. No.: 484,275

[52] U.S. Cl. ..... 53/29; 53/37; 53/187; 53/385

[51] Int. Cl.[2] ..... B65B 1/06

[58] Field of Search ..... 53/182, 187, 248, 29, 53/37, 385, 183, 384

[56] References Cited

UNITED STATES PATENTS

| | | | |
|---|---|---|---|
| 2,994,997 | 8/1961 | Gwinn et al. | 53/182 |
| 3,448,555 | 6/1969 | Shabram | 53/373 X |
| 3,449,889 | 6/1969 | Molitor, Jr. | 53/182 |
| 3,543,466 | 12/1970 | Forsberg | 53/384 X |
| 3,579,404 | 5/1971 | Spitznagel | 53/182 X |
| 3,815,318 | 6/1974 | Lerner | 53/187 X |

*Primary Examiner*—Travis S. McGehee
*Assistant Examiner*—Horace M. Culver
*Attorney, Agent, or Firm*—Watts, Hoffmann, Fisher & Heinke Co.

[57] ABSTRACT

A packaging system for packaging articles in bag-like containers. An adjustable support disposed below a loading station receives the lower end of a container positioned in the loading station and articles loaded into the container. The support includes a pair of relatively movable members defining surfaces which converge toward each other to support the container when loaded. The spacing and relative inclination between the members is adjustable to accommodate different sized articles and containers. Since the members form a downwardly converging support, articles being dropped into a container being loaded are funneled between the members which absorb the impact of the falling articles.

21 Claims, 5 Drawing Figures

11
16
17
14
15
12
51
50
63a
62
63b
52
53
65
66
64
4
136
134
131
122
124
128
102
115
114
160
111
145
146
144
165
166
167
164
162
112
110
3

PACKAGING METHOD AND APPARATUS

CROSS REFERENCE TO RELATED PATENTS

Flexible Container Strips, U.S. Pat. No. 3,254,828 issued June 7, 1966, to Hershey Lerner. This patent will be referred to as the "Article Patent".

Mechanism for Automatic Feeding, Loading, and Sealing Bags, U.S. Pat. No. 3,477,196 issued Nov. 11, 1969, to Bernard Lerner. This patent will be referred to as the "Machine Patent".

Packaging Method and Apparatus, U.S. Pat. No. 3,815,318 issued June 11, 1974, to Bernard Lerner. This patent will be referred to as the "Automatic Machine Patent", the disclosure of which is incorporated by reference.

BACKGROUND OF THE INVENTION

1. Field of the Invention

The present invention relates to a packaging system for packaging articles in flexible, bag-like containers, and more particularly to the use of a packaging apparatus having a novel and improved support for absorbing stresses which would otherwise be imposed on the container by the impact of the articles being dropped into the container during loading.

2. Prior Art

Each of the referenced patents describes the utilization of a plastic web composed of a chain of interconnected bags. The bags are each open on one face while the other face of each bag is connected to a contiguous bag along a line of weakness.

A simple mechanism for using a web of bags in packaging is described in the Article Patent. A coiled web is positioned on a mandrel in a carton. A blower is coupled to the carton to provide a positive pressure within the carton. Bags are fed, closed end first, through a slot in the carton. As the bags emerge from the carton they are inflated by a flow of air emitted from the slot due to the positive pressure in the carton. A product is inserted in the inflated bag. The operator then moves the web until the next bag emerges from the box and inflates, and separates the loaded bag for a sealing operation.

In the Machine Patent, a machine is described and claimed which dispenses the bags, seals them and then severs them in sequential, automatic operations. In addition, the machine is adapted to be connected to automatic counting and conveying equipment so that the products being packaged are all automatically measured and deposited in the bags as the bags are fed to a load station.

In the past, a commonly-used system for dispensing, separating and sealing packages has been basically manual. For these basically manual operations, a machine similar in appearance to that shown in the Machine Patent has been the most widely used. With this commercially-successful arrangement, a web of bags is mounted on a mandrel within a housing. The web is fed through an exit slot near the top of the housing and then downwardly until an open bag is at a load station near the top of the machine and near the exit slot.

In use, the operator deposits the product to be packaged in the open bag at the load station. The operator then grasps the loaded bag, pulling it downwardly until the next bag is at the load station. The loaded bag is then manually severed and the open end is inserted between the jaws of a heat sealer provided near the base of the housing. The jaws are then actuated to close and effect a sealing of the bag. After a predetermined time interval, when a seal has been effected, the jaws will open, allowing the bag to drop in a box or other receptacle beneath the machine.

With the device of the Machine Patent there is a limitation as to the length of a bag which can be handled in that sealing and severing are performed at stations below the load station and along a path of web travel. In addition, while the described machine is quite satisfactory for many applications, the machine does not afford flexibility of optional, often efficient, semi-automatic operation. Neither does it permit the feeding of the web until both the loading and the sealing steps of a cycle have been completed.

The Automatic Machine Patent provided advantages over the prior Machine Patent which included a construction in which the sealing of a loaded bag was effected concurrently with the feed of the next bag. This was accomplished by laterally offsetting the heat-sealing operation from the path of travel of the web into the loading station. The Automatic Machine had other advantages which are described in greater detail in the Automatic Machine Patent. One disadvantage of the Automatic Machine Patent was that in reducing the cycle time by effecting concurrent sealing and feeding, the advantages of the Machine Patent in assuring registration of the two faces of a loaded bag was lost.

When one loads a bag which has one face open and the other face connected by a line of weakness to a web, the expansion of the bag occasioned by the presence of the contents, and the distortions caused by the stresses of the weight of the contents, cause the disconnected face to become malaligned with the connected face. Loading a connected bag may also cause some premature partial severing of the connected face from the web. This distortion and partial severing causes a malalignment which is described in detail in the Machine Patent and which was solved in the Machine Patent. Prior to the present invention one had, then, the option of sealing with concurrent feed or automatic registration of the two faces of a loaded container, but not both.

Various types of bag supports have been provided in the past to support a bag at a load station. Simple shelves were used, for example, in connection with the basically manual system described above. The Article Patent and the Machine Patent each show systems for supporting a bag as it is loaded. Reciprocally movable shelves have been proposed for machines of the Automatic Machine Patent. These supports are illustrative of the many types of supports which have been provided, many of which, prior to the present invention, were not susceptible for use with the device of the Automatic Machine Patent because in one way or another they would interfere with the preferred and described method of operating that machine. That is, they would prevent concurrent sealing and web feeding or they would interfere with one or more of the operations such as by remaining in the path of a loaded container. While a movable support might overcome the interference problem, nothing has been proposed which would afford support for the container as it is being loaded, concurrent feeding and sealing as is taught in the Automatic Machine Patent, and assured registration of the faces of a loaded bag prior to the commencement of the sealing operation.

SUMMARY OF THE INVENTION

The present invention overcomes the foregoing and other drawbacks of the prior art by providing a packaging apparatus including an adjustable, removable support for protecting containers during loading and sealing.

In accordance with one feature of the present invention, a pair of independently adjustable movable support members are positioned near the container loading station. The supports are each of adjustable length, and can be selectively positioned to receive the lower portion of a container and absorb the impact of articles on a container as it is being loaded.

In its preferred embodiment, the support members define a pair of downwardly converging surfaces which form a wedge-shaped trough below the loading station. A container positioned in the loading station extends into the trough. Articles loaded into the container fall first into the wide target area of the upper trough region and are then funneled into the lower trough region where the converging support members engage the articles, absorb their impact, and assist in supporting their weight. After the container is loaded, the support members are moved relatively away from each other to release the loaded container.

In the preferred embodiment, the improved support is used on an apparatus of the type described in the Automatic Machine Patent and is mounted for pivotal movement together with the heater, sealer and gripper bar assembly to assist in supporting the loaded container while it is being sealed and severed from the remainder of the web.

One of the outstanding features of this invention is that the bag support is positioned such that it is laterally offset from a vertical path of web travel. A lower end of a bag being loaded, and of a loaded bag prior to sealing, is maintained in a position forward of both the path of travel and the sealing station which is behind that path. Accordingly, the rearward face of the bag which is connected to the web is unloaded to accomplish the advantages of the Machine Patent with the consequence that a heavily loaded bag has appropriate registry of the front and rear faces of the bag. The sealing and severing operation is accomplished in the manner described in the Automatic Machine Patent so that, unlike the Machine Patent, web feed can be accomplished concurrent with the sealing operation.

From the foregoing, it will be seen that a general object of the present invention is to provide a novel and improved packaging apparatus including an adjustable support to absorb stresses imposed on a packaging container typically during loading of articles into the container.

Other advantageous features and a fuller understanding of the invention may be had by referring to the following detailed description and claims taken in conjunction with the accompanying drawings.

DESCRIPTION OF THE PREFERRED EMBODIMENT

Figure 1:
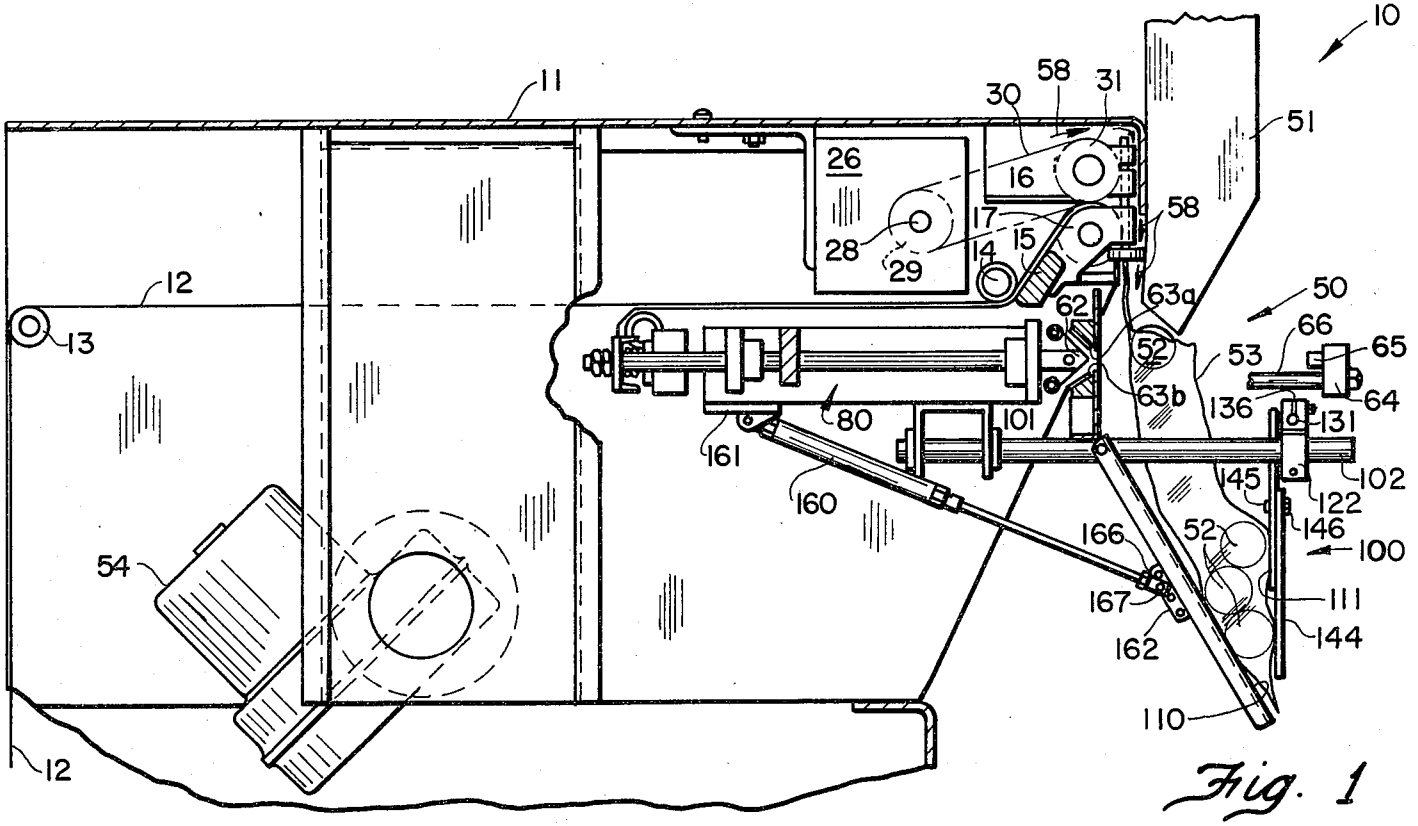
FIG. 1 is a side elevational view of a packaging machine constructed in accordance with the present invention.
Figure 2:
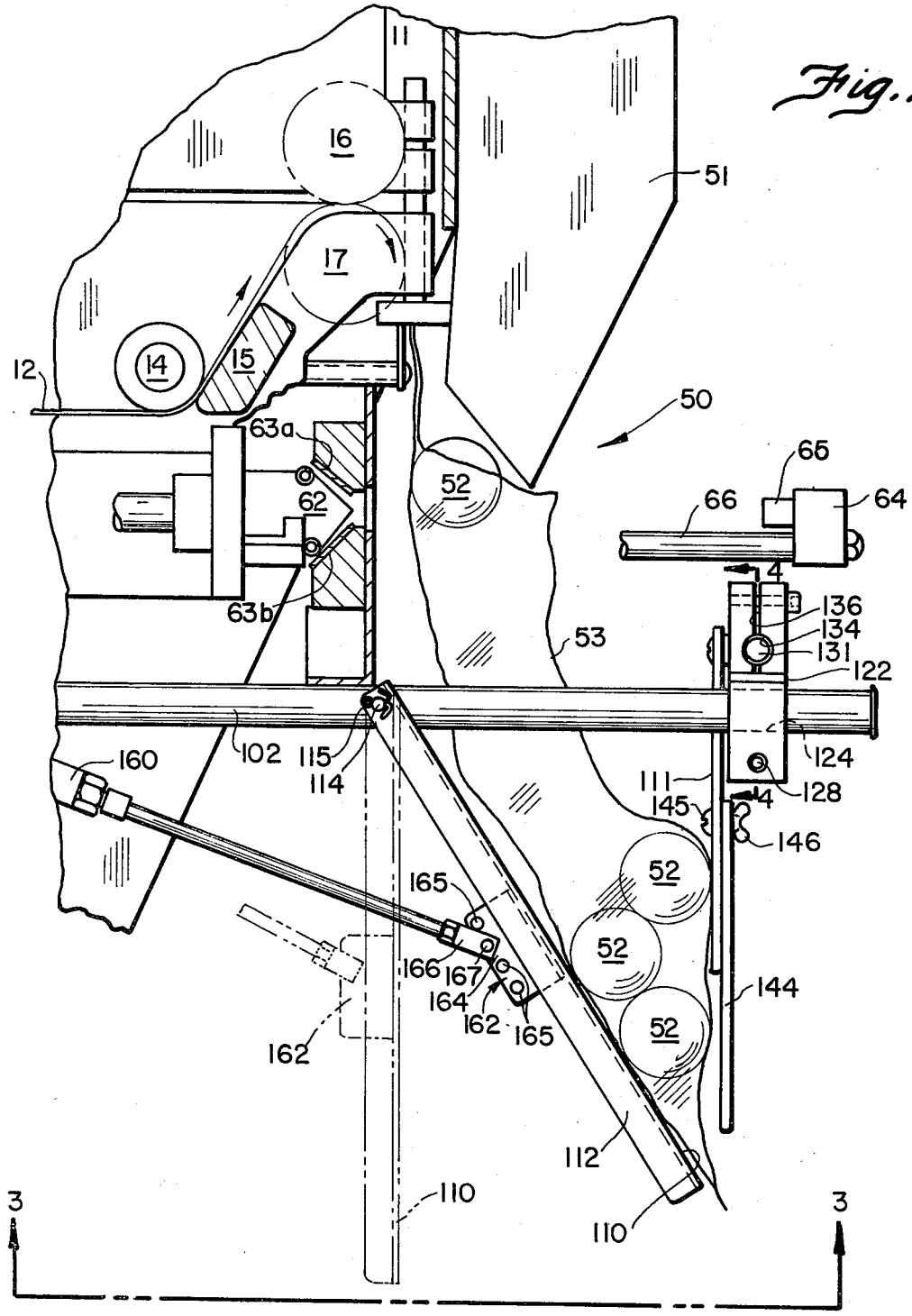
FIG. 2 is a side elevational view on an enlarged scale of a portion of the apparatus of FIG. 1.

Referring to FIGS. 1 and 2, a packaging machine is in most respects the same as that described in detail in the Automatic Machine Patent, and the common features of this machine will be only briefly described.

The machine 10 includes a protective outer cabinet 11. A packaging web 12 is fed from a storage region (not shown) in the lower portion of the cabinet 11 to a loading station indicated generally by the reference numeral 50. The packaging web 12 is preferably of the type which has a series of preformed interconnected heat-sealable, bag-like containers with each container having a closed leading end connected along a preformed line of weakness to the open end of a preceeding container.

The machine 10 defines a path of travel for feeding the web 12 through the cabinet 11 from the storage region to the loading station 50. Referring to FIG. 1, the web 12 is fed substantially vertically upward from the storage area and reeved over a first idler roller 13. From the first idler roller 13, the web 12 extends substantially horizontally and is reeved around a second idler roller 14. From the second idler roller 14, the web 12 is directed upwardly over a guide block 15 toward a pair of feed rolls 16, 17. The web 12 is fed between the rolls 16, 17 and extends downwardly to the loading station 50.

A drive motor 26 rotates the rolls 16, 17 to automatically advance the web 12 along its feed path. The motor 26 has output shaft 28. A drive pulley 29 is mounted on the output shaft 28. A drive belt 30 is reeved around drive pulley 29 and around a driven pulley 31. The driven pulley 31 is secured to the upper feed roll 16.

A bag-like container 53 formed on the web 12 is shown positioned at the loading station 50. A blower 54 is provided in the cabinet 11 for opening the container 53. A stream of pressurized air from the blower 54 is directed through the cabinet 11 over feed roll 16 and downwardly toward the loading station 50 as shown by arrows 58. While the relatively gentle flow of pressurized air provided by the blower 54 is usually sufficient to open the container at the loading station, an auxiliary air flow system may be added to provide a brief burst of high velocity pressurized air to insure opening of the container 53. Such an auxiliary system for opening bags is described in the Automatic Machine Patent.

A loading chute 51 is provided at the loading station 50 to discharge articles to be loaded downwardly and into the opened container 53. The discharge of articles 52 from the chute 51 is timed to occur after the container 53 has been positioned and opened at the loading station 50.

Following the loading of articles into the container 53, the container 53 is closed and heat-sealed to form a package. As is described in the Automatic Machine Patent, support rods 66 carry a movable sealing bar 64 provided with a resilient pad 65. A pneumatic cylinder (not shown) is operative to retract the support rods to bring the resilient pad 65 into engagement with the open end of the loaded container 53 and to close the container 53 by clamping the open end faces together against a pair of gripper bars 63*a*, 63*b* and a heater bar 62. The heater bar 62 seals the clamped bag faces.

As is described in the Automatic Machine Patent, the assembly including the sealing bar 64, the sealing bar support rods 66, the gripper bars 63*a*, 63*b* and the heater bar 62 is pivotally mounted on a frame structure 80. After a loaded container has been gripped by the sealing, gripper and heater bars, the frame structure 80 is pivoted downwardly to sever the loaded container 53 from the remainder of the packaging web 12.

The present invention provides a novel support structure for use on packaging machines of the type described in the Automatic Machine Patent. The support is indicated generally by the numeral 100 In FIGS. 1–3. The support 100 is operable to receive a container 53 positioned in the loading station and to assist in supporting articles loaded into the container.

An elongated mounting bracket 101 of inverted U-shaped cross section is secured to the frame structure 80. A pair of support rods 102, 103 are carried by the bracket 101. Rearward end regions of the rods 102, 103 extend through holes formed in opposite end regions of the mounting bracket 101 and are secured to the bracket 101 by suitable locking collars 104, 105, respectively.

A pair of support plates 110, 111 are movably carried on the rods 102, 103. The plates 110, 111 depend from the rods 102, 103 as will be explained to receive opposite sides of a container 53 positioned in the loading station 53.

The support plate 110 is movably carried on central portions of the rods 102, 103. The support plate 110 is pivotally secured to the rods 102, 103 for movement between an extended position shown in solid lines in FIG. 2, and a retracted position shown in phantom in FIG. 2. The plate 110 is planar except for rearwardly turned side regions 112, 113. A rod 114 extends through aligned holes in the side regions 112, 113 and the rods 102, 103 to pivotally mount the plate 110 on the rods 102, 103. A pair of cotter pins 115, 116 extend through holes in opposite end regions of the rod 114 and hold it in place relative to the rods 102, 103.

A pair of brackets 122, 123 are carried on the forward end regions of the rods 102, 103. The brackets 122, 123 have holes 124, 125 which receive the rods 102, 103. Slots 126, 127 are formed in the brackets 122, 123 intersecting the holes 124, 125 in planes coincident with the axes of the holes 124, 125. A pair of cap screws 128, 129 are threaded into the brackets 122, 123 transversely of the slots 126, 127 to releasably clamp the brackets 122, 123 in place on the rods 102, 103.

Figure 5:
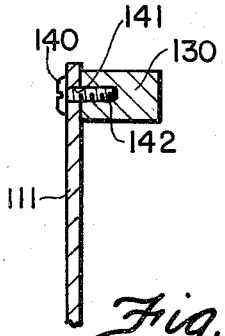
FIG. 5 is a cross-sectional view as seen from the plane indicated by the line 5—5 in FIG. 4.

A cross-member 130 is carried by the brackets 122, 123. The cross member 130 has a rectangular cross section, as best seen in FIG. 5, except for opposite end regions which are turned to provide round portions 131, 132. The round portions 131, 132 are received in aligned holes 134, 135 formed in the brackets 122, 123. A pair of slots 136, 137 formed in the brackets 122, 123 intersect the holes 134, 135 in a manner identical to the relationship between the holes 124, 125 and the slots 126, 127. Cap screws 138, 139 threaded into the brackets 122, 123 transversely of the slots 136, 137 serve to releasably clamp the round end portions 131, 132 of the cross member 130 in place relative to the brackets 122, 123.

The support plate 111 is secured to the cross member 130. As is best seen in FIG. 5, threaded fasteners 140 extend through holes 141 in the plate 111 and are threaded into holes 142 in the cross member 130 to hold the plate 111 in place on the cross member 130.

An extension plate 144 is carried by the plate 111. Threaded fasteners 145 extend through aligned holes in the plates 111, 144 and are secured by wing nuts 146 to releasably secure the plates 111, 144 together. The extension plate 144 is preferably provided with a plurality of slot-like holes to receive the fasteners 145 thereby permitting the combined length of the plates 111, 144 to be readily adjusted.

The round end regions of the cross member 130 are free to rotate in the bracket holes 134, 135 when the cap screws 138, 139 are loosened, thereby permitting the adjustment of the angle of inclination of the plates 111, 144. The brackets 122, 123 can translate along the rods 102, 103 when the cap screws 128, 129 are loosened, thereby permitting the variable positioning of the plates 111, 144 along the rods 102, 103.

Figure 3:
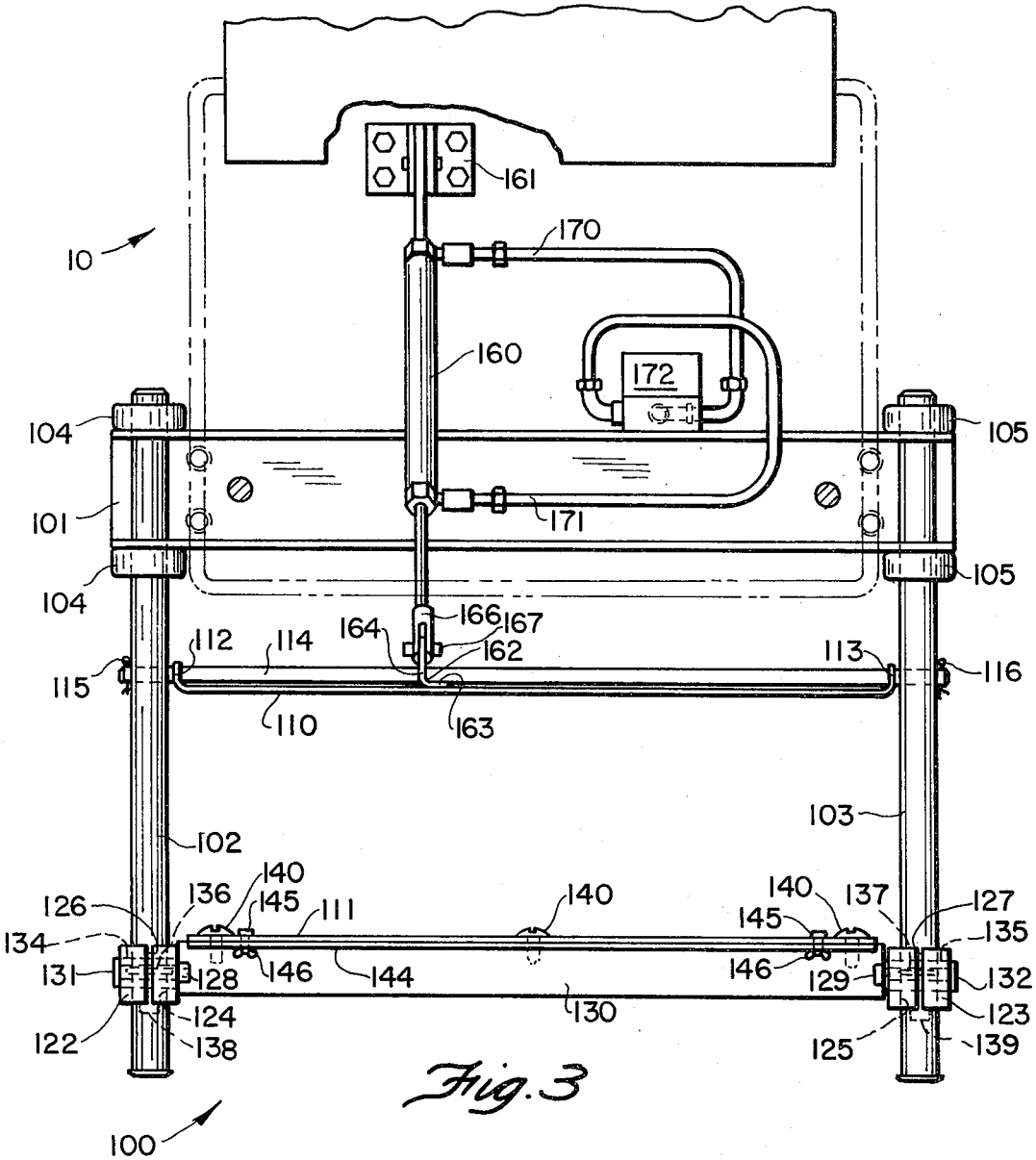
FIG. 3 is a bottom plan view of a portion of the packaging machine as seen from the plane indicated by the line 3—3 in FIG. 2.
Figure 4:
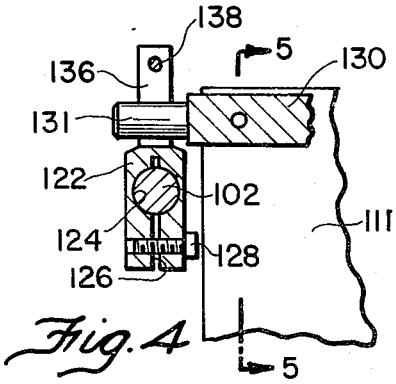
FIG. 4 is a cross-sectional view as seen from the plane indicated by the line 4—4 in FIG. 2.

Referring to FIGS. 1 and 3, an extensible pneumatic cylinder 160 is provided for pivoting the plate 110 about the axis of the rod 114. A bracket 161 secures one end region of the cylinder 160 to the frame structure 80. A bracket 102 secures the other end of the cylinder 160 to the plate 110.

The bracket 162 provides an adjustable connection between the cylinder 160 and the plate 110. The bracket 162 is of L-shaped configuration. One leg 163 of the bracket 162 is welded to the plate 110. The other leg 164, is provided with four spaced holes 165. A yoke 166 carried on the cylinder 160 receives the leg 164. A pin 167 extends through one of the holes 165 and through aligned holes in the yoke to removably connect the cylinder 160 and the bracket 162. The inclination of plate 110 when the cylinder 160 is fully extended is adjusted by selecting which of the holes 165 is to be used to connect with the yoke 166.

The pneumatic cylinder 160 controls the position and the movement of plate 110. Pneumatic conduits 170, 171 supply pressurized air to the cylinder 160 from a conventional solenoid operated valve 172 to retract and extend the cylinder 160. In operation, the cylinder 160 is extended to bring the plate 110 into close proximity to the plates 111, 144 to help support a container 53, and is retracted to move the plate 110 away from the plates 111, 144 to release a loaded container 53.

The operation of the cylinder 160 is coordinated with the operation of the packaging machine 10. As a container 53 is fed to the loading station 50, the cylinder 160 extends to position the plates 110, 111 so that a downwardly converging, V-shaped trough is provided to receive lower portions of the container 53. This relative positioning of the plates 110, 111 is preferably retained until the container 53 has been loaded, sealed and severed from the remainder of the web 12 by the machine operation described in the Automatic Machine Patent.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed.

What is claimed is:

1. A packaging apparatus comprising:

a. structure for feeding a packaging web along a path and for positioning a container on the web in a loading station;
b. support means positioned near said loading station for receiving lower portions of such positioned container;
c. said support means including a pair of relatively movable members movable between first and second positions, said members in the first position converging downwardly toward each other into engagement with opposite sides of lower portions of such engagement with opposite sides of lower portions of such container at locations laterally offset from said path whereby to shift a container to be loaded out of said path and cause the opposite sides of the container to be in substantial registry when the container is loaded, said members in said second position being spaced apart sufficiently to permit movement of the loaded container back from the offset position and the passage of such loaded container between the members; and,
d. means for effecting relative movement of said members between said first and second positions.

2. The apparatus of claim 1 wherein said support means includes adjustment means for selectively controlling the relative inclination between said members when said members are in said first position.

3. The apparatus of claim 1 wherein said support means includes adjustment means for selectively controlling the relative spacing between said members when said members are in said first position.

4. The apparatus of claim 1 wherein at least one of said members is of adjustable length.

5. The apparatus of claim 1 wherein said support means additionally includes:
a. a pair of spaced elongated supports extending transversely of said path for supporting said members and receiving such container therebetween;
b. adjustment means connecting one of said members to said supports and being operable to releasably rigidly secure said one member in a plurality of selected positions;
c. mounting means movably mounting the other of said members on said supports for movement toward and away from said one member.

6. The apparatus of claim 5 wherein said mounting means provides a pivotal connection between said other member and said supports.

7. The apparatus of claim 6 wherein said means for effecting relative movement connects with said other member for moving said other member toward and away from said one member.

8. A method of packaging articles comprising the steps of:
a. feeding a packaging web along a path of travel to position a container on the web in a loading station;
b. diverting the web laterally from the path with a support structure defining spaced downwardly converging supporting surfaces for receiving lower portions of such container positioned in said loading station;
c. loading the container at the loading station by dropping material into the container while said support structure maintains the container in its laterally offset position and absorbs at least a part of the impact of the material on such container; and,
d. subsequently moving at least a portion of said support structure out of engagement with such loaded container.

9. The method of claim 8 wherein the material comprises at least one article and additionally including the step of adjusting said support structure to position said surfaces in accordance with the size of the article to be packaged to provide support for the article and relieve stresses which would otherwise be imposed on such container during loading.

10. A packaging method comprising the steps of:
a. feeding a packaging web along a path of travel to position a container on the web in a loading station;
b. diverting the container from said path with one of a pair of spaced, relatively movable members, said members being near said loading station for receiving lower portions of a container positioned on said loading station and positioned to provide an inclined downwardly converging trough-like support loosely receiving opposite sides of such container;
c. loading material into such container while said members absorb at least a part of the impact of the material on such container and while the members support the container to relieve stresses which would otherwise be imposed on the web;
d. closing and securing the container after it is loaded; and,
e. moving said members relatively away from each other after the container is closed to release their contact with such container to permit the container to pass between the members after it has been closed.

11. The packaging method of claim 10 additionally including the step of severing such container from the remainder of the web subsequent to loading and prior to moving said members.

12. The method of claim 10 further including the step of moving said members relatively toward each other subsequent to discharging said loaded container from the loading station.

13. The method of claim 8 wherein the container is closed after loading and while it is supported.

14. A packaging apparatus comprising:
a. structure for feeding a packaging web along a path and for positioning a container on the web in a loading station;
b. support means positioned near said loading station for receiving lower portions of such positioned container;
c. said support means including a pair of relatively movable members movable between a first position where surfaces of said members converge downwardly toward each other toward engagement with opposite sides of lower portions of such container, and a second position where said members are spaced apart sufficiently to permit the passage of such loaded container therebetween;
d. said support means additionally includes:
i. a pair of spaced elongated supports extending transversely of said path for supporting said members and receiving such container therebetween;
ii. adjustment means connecting one of said members to said supports and being operable to releasably rigidly secure said one member in a plurality of selected positions;

iii. mounting means movably mounting the other of said members on said supports for movement toward and away from said one member;

e. said mounting means providing a pivotal connection between said other member and said supports;

f. means for effecting relative movement being connected to said other member for moving said other member toward and away from said one member;

g. said adjustment means including a pair of brackets carried on said supports, first fastening means for releasably holding said brackets in selected positions on said supports, a cross member extending between said brackets and supporting said one member, and second fastening means for releasably holding said cross member in selected positions on said brackets; and, h. means for effecting relative movement of said members between said first and second positions.

15. A packaging apparatus comprising:

a. structure for feeding a web of material from a supply along a path of travel to position an open container forming a portion of the web at a load station;

b. container support means to deflect such container laterally from the path as it is fed to the load station and subsequently support the container at the station as it is loaded;

c. the support means including a pair of container support surfaces positioned to engage respectively opposite faces of the container; and, d. at least one of the surfaces being positioned transversely of and across the path while the container is loaded.

16. The apparatus of claim 15 wherein the container support means deflects a container laterally to one side of the path and wherein a heat seal structure is provided and positioned to effect a heat seal at a sealing station offset to the opposite side of said path.

17. The apparatus of claim 16 wherein said one surface is provided by a movable member that is shiftable to permit a loaded container to be moved out of the loaded station.

18. The apparatus of claim 16 wherein said one surface is defined by a movable member that is movable away from the other surface to permit a loaded container to return to the path and pass between the two surfaces.

19. The process of loading a container which forms a portion of a web, comprising:

a. feeding the web along a path of travel to move the container toward and into a load station;

b. diverting the container from the path as it is fed into the load station in a direction such that a face of the container connected to the web becomes the underside of the container;

c. supporting the container at the load station;

d. closing the container and disconnecting it from the web after it has been loaded.

20. The process of claim 19 wherein the support of the container is maintained until after it has been closed.

21. The process of claim 20 wherein a container is heat sealed after closing at a station laterally offset from the path of travel in a direction opposite the lateral deflection of the container.

* * * * *